US006354230B1

(12) United States Patent
Maschio

(10) Patent No.: US 6,354,230 B1
(45) Date of Patent: Mar. 12, 2002

(54) PLASTICS MATERIAL MODULAR PALLET

(76) Inventor: Pietro Maschio, Via Lazio, 16, 20056 Grezzago (Milano) (IT)

( * ) Notice: Subject to any disclaimer, the term of this patent is extended or adjusted under 35 U.S.C. 154(b) by 0 days.

(21) Appl. No.: 09/582,454

(22) PCT Filed: Dec. 9, 1998

(86) PCT No.: PCT/IT98/00353

§ 371 Date: Sep. 6, 2000

§ 102(e) Date: Sep. 6, 2000

(87) PCT Pub. No.: WO99/35041

PCT Pub. Date: Jul. 15, 1999

(30) Foreign Application Priority Data

Jan. 7, 1998 (IT) ..... MI98A0003

(51) Int. Cl.[7] ..... B65D 19/38
(52) U.S. Cl. ..... 108/57.25; 108/901
(58) Field of Search ..... 108/57.25, 901, 108/902, 56.1, 56.7, 51.11

(56) References Cited

U.S. PATENT DOCUMENTS

| | | | | | |
|---|---|---|---|---|---|
| 4,316,419 | A | * | 2/1982 | Cupido | 108/902 X |
| 5,417,167 | A | * | 5/1995 | Sadr | 108/902 X |
| 5,456,189 | A | * | 10/1995 | Belle Isle | 108/902 X |
| 5,458,069 | A | * | 10/1995 | Stolzman | 108/901 X |
| 5,579,701 | A | * | 12/1996 | Fook Wah | 108/56.1 |
| 5,584,951 | A | * | 12/1996 | MacFarland | 108/56.1 X |
| 5,868,080 | A | * | 2/1999 | Wyler et al. | 108/57.25 |
| 5,896,818 | A | * | 4/1999 | Phillips | 108/56.1 X |
| 6,029,583 | A | * | 2/2000 | LeTrudet | 108/57.25 |
| 6,125,770 | A | * | 10/2000 | Brandenburg | 108/57.25 |

* cited by examiner

*Primary Examiner*—Jose V. Chen
(74) *Attorney, Agent, or Firm*—Hedman & Costigan, P.C.

(57) ABSTRACT

A plastics material modular pallet, comprising a plurality of supporting elements operatively coupled to one another by at least a further element cross arranged with respect to the supporting elements. The pallet according to the invention can be fitted to a plurality of load requirements, which can be easily carried out by the pallet user. Further, the invention offers ease of production, low maintenance and low cost.

1 Claim, 5 Drawing Sheets

PLASTICS MATERIAL MODULAR PALLET

BACKGROUND OF THE INVENTION

The present invention relates to a plastics material modular pallet.

As is known, in the industrial shipment field are broadly used pallets for bearing and/or supporting any types of loads such as parts of apparatus, half-finished products, cisterns or tanks and so on.

Prior pallets are conventionally made of wood, steel or plastics materials. In particular, plastics materials are very advantageous owing to their small weight, strength and atmospheric agent resistance properties and are quickly replacing the other mentioned materials. This replacement relates specifically the pallets provided for supporting and/or bearing cisterns or tanks for carrying different types of liquids, up to a specific gravity of about 1.9 $Kg/dm^3$.

While the above mentioned prior pallets solve the indicated technical problem, they are affected by the following disadvantages.

The wood or steel pallets are affected by a lot of drawbacks directly deriving from the material forming said pallets. In particular, wood pallets can be easily spoiled under the effect of atmospheric agents, and their mechanical strength characteristics are susceptible to greatly change in the time; the steel pallets, on the other hand, have a greater strength, which, however, is related to a significative weight increase; moreover, steel pallets must be properly protected against corrosion.

Plastics material pallets would allow to overcome the main problems of the other material pallets and, since plastics material pallets can be constructed with a modular construction, they would be very practical in use.

However, prior plastics material pallets are also affected by two types of drawbacks.

The first is the practical impossibility of changing the pallet strength depending on the load. In fact, for example, the cisterns supported by said pallets can be filled with greatly different specific gravity liquids: i.e. specific gravity values from about 1 $Kg/dm^3$ for water to about 1.4 $Kg/dm^3$ for food liquids and up to about 1.9 $Kg/dm^3$ for special liquids used in some industrial processes.

It should be apparent that, as the liquid changes, also the strength properties of the pallet would be changed, thereby it would be necessary to use pallets of different size, depending on the load to be supported, or it would be required to use pallets designed for supporting, the load capability of the cistern being the same, the liquid having the greatest specific gravity.

In both cases, the pallet cost would greatly increase.

The further drawback of prior plastics material pallets for supporting cisterns is the corrosion in the time of the collecting tray thereof. The latter, which is conventionally arranged under the faucet of the cistern, is provided for collecting possible liquid leakages occurring as the stored liquid is poured, which leakages, in the case of the noxious liquid, would be very dangerous.

In particular, since the collecting tray is made of steel, it is much or more corroded in the time: thus, it is necessary to replace the overall pallet in order to allow an efficient collection, since the tray cannot be separated from the pallet. Thus, in this case too, the involved cost for the user would inevitably increase.

SUMMARY OF THE INVENTION

Accordingly, the aim of the present invention is to overcome the above disclosed drawbacks of the prior art.

To achieve the above aim, the invention provides a plastics material modular pallet, very practical in operation, efficient, constructionally simple, which can be fitted to any load requirements and used without any maintenance requirements.

Briefly, according to the invention, the above aim is achieved by a plastic material modular pallet comprising a plurality of supporting elements, operatively coupled to one another by at least a further element cross arranged with respect to said supporting element, said cross arranged element including a plurality of recesses for engaging therein one or more structural reinforcement elements.

The plastics material modular pallet according to the invention is characterized by the characteristics disclosed in claim 1.

The plastics material modular pallet according to the invention provides the following advantages.

Each pallet according to the invention can be fitted to a lot of different load requirements, by quick and simple fitting operations, which can be easily carried out by the pallet user.

A further advantage is that the subject pallet is practically free of any maintenance requirements, and, moreover, it would not be necessary to replace the pallets because of the disclosed tray corrosion problems, with a self-evident reduction of the operation cost.

Finally, the individual components of the pallet according to the invention can be easily made by known making method on conventional existing pallet making lines, with very small modifications to the existing systems. Thus, the pallet making cost can be compared to that of a prior pallet, whereas the operating cost is much smaller.

BRIEF DESCRIPTION OF THE DRAWINGS

Further characteristics, advantages and constructional details of the plastics material modular pallet according to the present invention will become more apparent from the following detailed disclosure, with reference to the accompanying drawings, in which a preferred embodiment of the invention is shown by way of an indicative but not limitative example.

In the drawings.

BRIEF DESCRIPTION OF THE PREFERRED EMBODIMENTS

Figure 1:
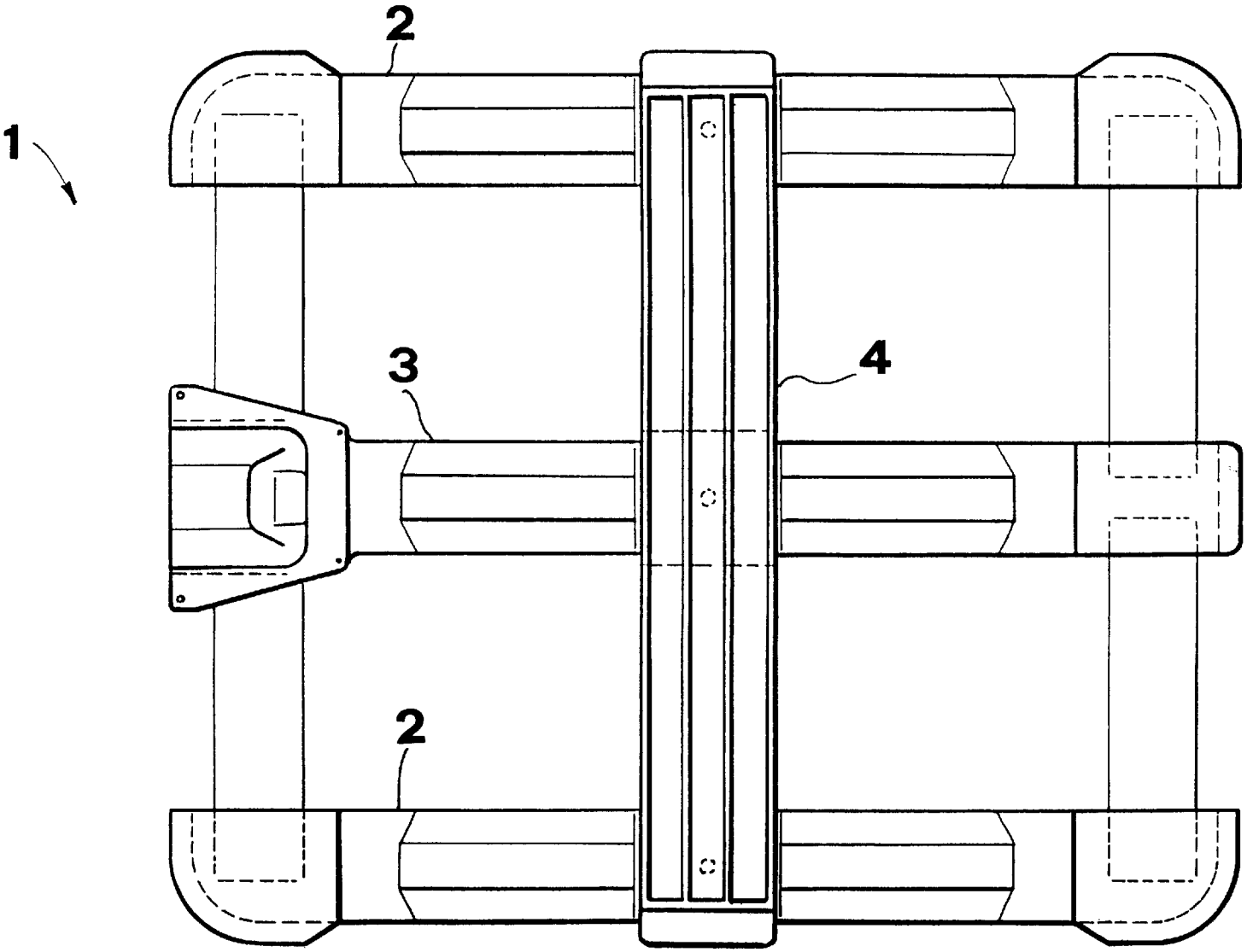
FIG. 1 is a top plan view of the plastics material modular pallet according to the invention.
Figure 2:
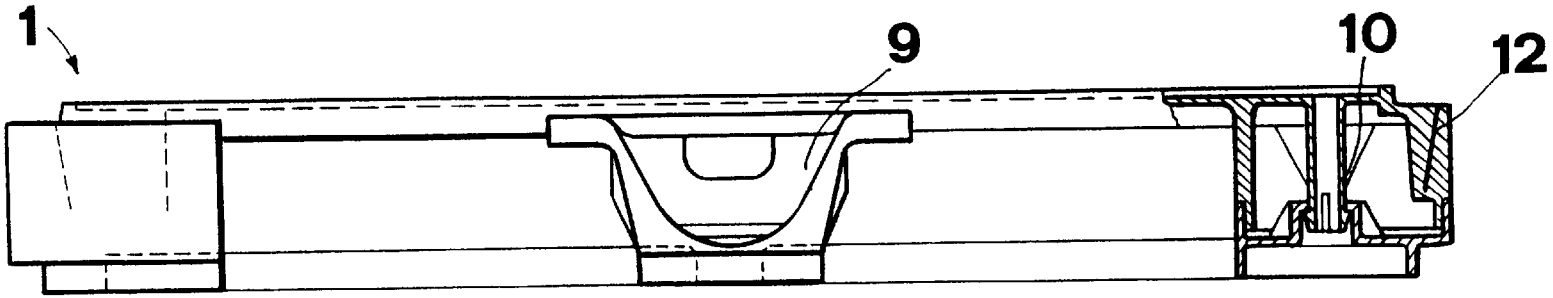
FIG. 2 is a side view, as partially cross-sectioned, the pallet shown in FIG. 1.
Figure 3:
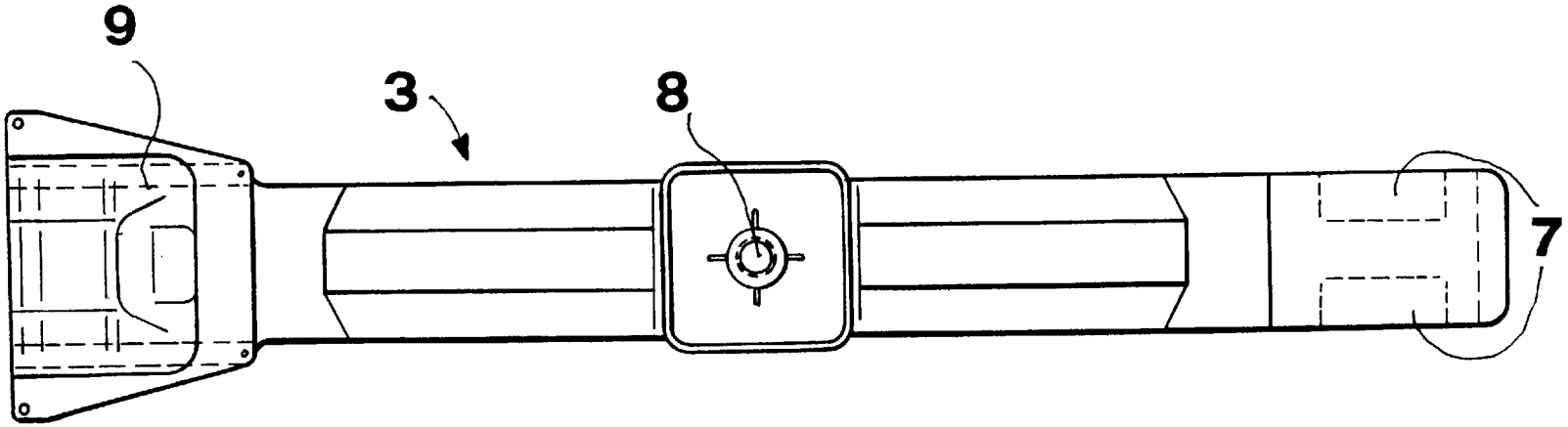
FIG. 3 is a further top plan view of a first element included in the pallet shown in FIG. 1.
Figure 4:
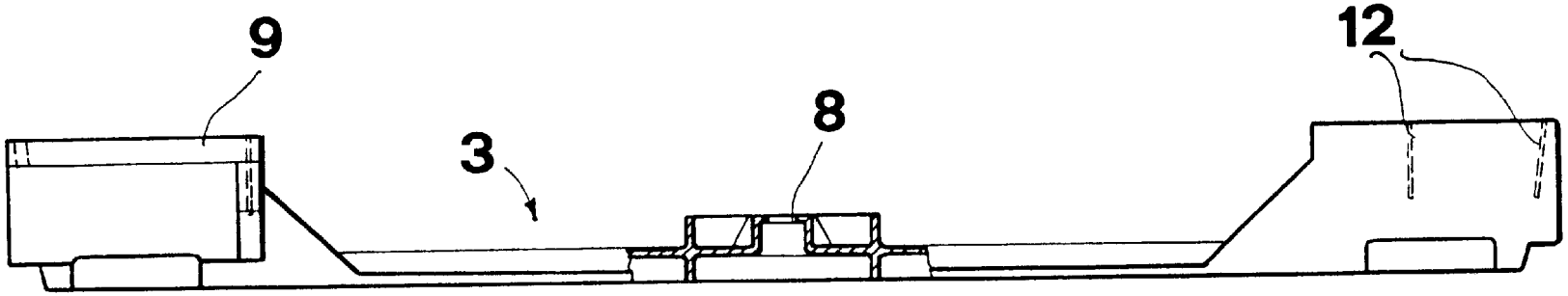
FIG. 4 is a front view, as partially cross-sectioned of the element shown in FIG. 3.
Figure 5:
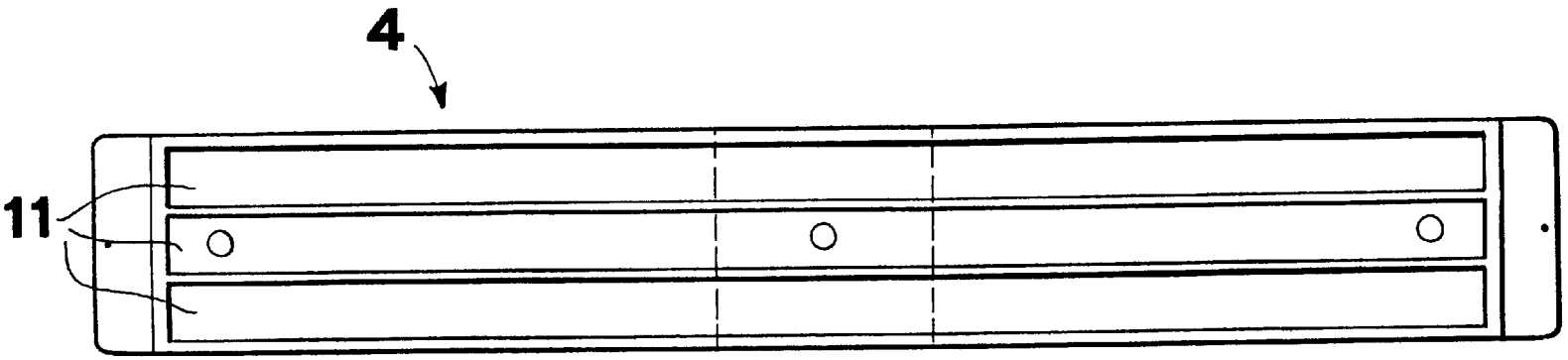
FIG. 5 is a further top plan view of a second element included in the pallet shown in FIG. 1.
Figure 6:
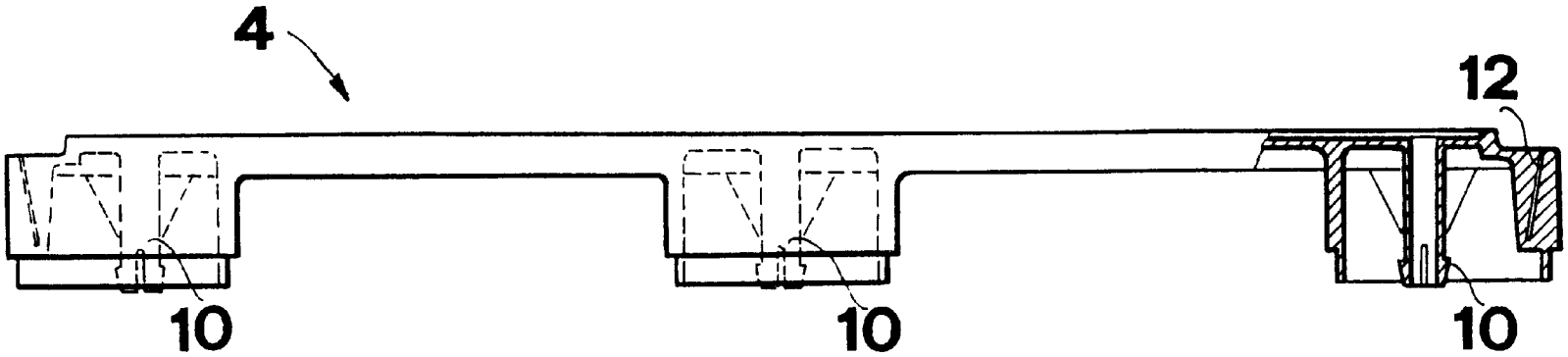
FIG. 6 is a front view, as partially cross-sectioned of the element shown in FIG. 5.
Figure 6A:
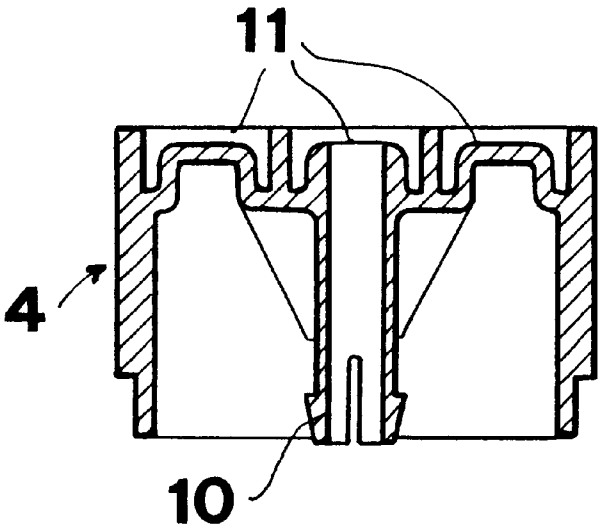
FIG. 6*a* is a cross-sectioned side view of the element shown in FIG. 5.
Figure 7:
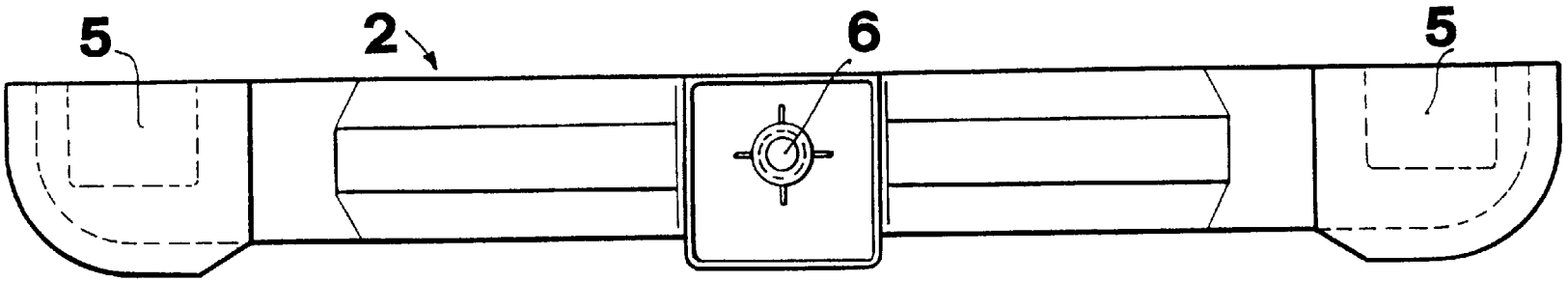
FIG. 7 is a top plan view of a third element included in the pallet shown in FIG. 1.
Figure 8:
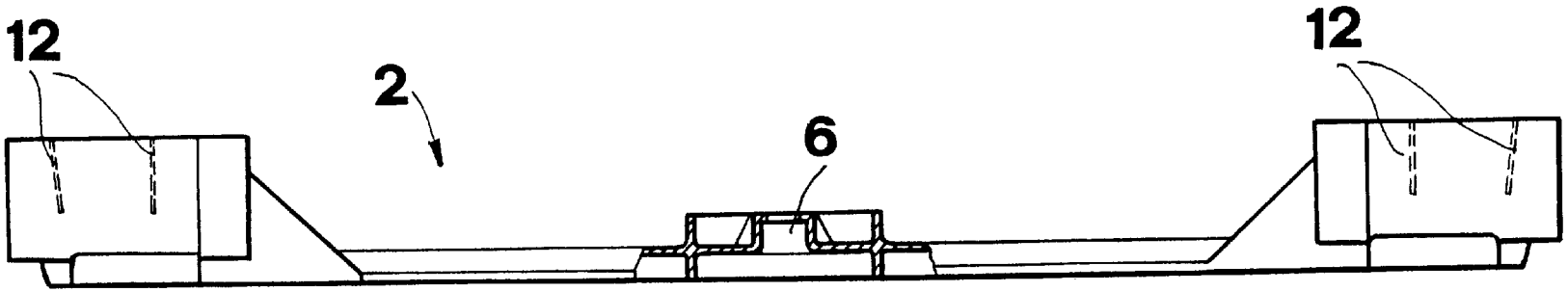
FIG. 8 is a partially cross-sectioned front view of the element shown in FIG. 7.

With reference to the number references of the above disclosed figures, the plastics material modular pallet 1 according to the invention comprises a pair of outer elements or longitudinal members 2, a central element or longitudinal member 3, and a further element cross-arranged with respect to the preceding elements, or cross-member 4.

The outer longitudinal members 2 are provided, at each end portion thereof, with a prismatic recess 5 for engaging therein and anti-tilting tie-member, whereas, at the middle thereof a female recess 6 is provided which, as it will be disclosed more apparent hereinafter, will allow the tie member 4 to be easily fastened.

The central longitudinal member 3 is provided, at each end portion thereof, with a pair of prismatic recesses 7, also provided for receiving therein the end portions of said anti-tilting tie members, whereas, at the middle thereof, is provided a further female recess or coupling element 8, identical to the disclosed female coupling element 6, and having the same function.

On one end, above one of said pair of recesses 7, a collecting tray 9 is provided, said collecting tray being made of the same plastics material used for making the pallet 1 according to the invention, and, accordingly, being devoid of any corrosion problems.

The tie or cross member 4 is arranged perpendicular to the above disclosed longitudinal members 2, 3 which are parallel to one another. Said cross-member 4 is provided at the top thereof, through the overall length thereof, with three C-shaped recesses 11 for engaging therein a corresponding number of metal reinforcement elements designed for modifying the value of the maximum load allowable for the overall pallet 1.

At the bottom thereof, the cross member 4 is provided with three attachment or male elements, of hook shape, 10 which, upon engaging in the female coupling elements 6, 8, will firmly fasten the cross-member 4 to the longitudinal members 2, 3. As shown, through the outer longitudinal members 2, the central longitudinal member 3, as well as through the cross-member 4, a plurality of holes 12 are provided, said holes being specifically designed for receiving therein a corresponding self-threading screw in order to fasten on the top of the pallet 1 a metal sheet panel, providing the bearing base for the load to be supported.

In this connection it should be apparent that the shape and size of the several elements constituting the plastics material modular pallet according to the invention can be changed depending on requirements, without departing from the scope of the present invention.

The assembling and operation of the plastics material modular pallet 1 according to the present invention can be easily deduced from the preceding disclosure.

Actually, after having arranged the longitudinal members 2, 3 in a parallel relationship with respect to one another, and after having assembled in the provided recesses 5, 7 the anti-tilting tie or cross members, the cross-member 4 will be fastened by engaging the three hook male elements 10 in the female recesses 6, 8, after having suitably arranged them on the outer longitudinal members 2 and central longitudinal member 3, and, finally, in said recesses 11 a set number of reinforcement elements will be engaged.

A metal sheet panel is then fastened by self-threading screws engaged in said holes 12, to the thus assembled pallet 1.

In this connection it should be pointed out that, upon assembling, the pallet 1 cannot be manually disassembled, but, for disassembling it, it would be necessary to use suitable disassembling tools for disengaging the cross member 4 from the longitudinal members 2, 3.

The thus made pallet 1, with the addition of a metal cage fastened by the same self-threading screws to said pallet, can support, for example, a liquid filled cistern or tank: in this connection it should be pointed out that it would be possible to modify the maximum load which can be applied on said pallet, by removing the metal sheet panel and modifying the number of metal reinforcements provided in said recesses 11 on said cross-member 4.

The, the pallet 1 could be stiffened or reinforced again, depending on the amount of liquid filled in said cistern, and depending on the liquid specific gravity.

As the pallet 1 is used for supporting different elements, then it would be still possible to modify the maximum strength values of said pallet, by removing or adding said metal reinforcement elements, which operation could be easily and quickly carried out.

What is claimed is:

1. A plastics material modular pallet, comprising a plurality of supporting elements (2, 3), operatively coupled to one another by at least a support element cross-arranged (4) with a plurality of recesses (11) for engaging therein one or more structural reinforcement elements, a support element (2) comprising an outer longitudinal element having a first and second end portion (5), opposed by a support element (2) comprising an outer longitudinal element having a first and second end portion (5) and between them a support element (3) having a first and second end portion (9), each having, at a middle portion thereof, a female coupling element (6) for engaging therein a corresponding male coupling element (10) provided on bottom of a cross-arranged support element (4), characterized in that said two outer longitudinal elements (2) are provided with a plurality of holes (12), at each end portion (5) of said two outer longitudinal elements (2), a recess for engaging therein a corresponding end portion of a tie member, a support element (3) between two outer longitudinal support elements comprising a plurality of holes (12), and at each end portion a pair of recesses for receiving a corresponding end portion of two tie members, whereas on an end portion a plastics material tray (9) is provided, said cross-arranged support element (4) is provided with a plurality of holes (12) and at the bottom thereof, with three hook male connecting elements (10) and, at a top thereof, with three C-shape recesses (11) designed for engaging therein up to three structural reinforcement elements.

* * * * *